United States Patent [19]

Bochow et al.

[11] 4,456,667

[45] Jun. 26, 1984

[54] TAMPERPROOF DOCUMENT AND A PROCESS FOR PRODUCING THE SAME

[75] Inventors: Richarda Bochow; Helmut Bergmann, both of Fallingbostel; Siegfried Eikemeier, Soltau, all of Fed. Rep. of Germany

[73] Assignee: Agfa-Gavaert Aktiengesellschaft, Leverkusen, Fed. Rep. of Germany

[21] Appl. No.: 401,655

[22] Filed: Jul. 26, 1982

[30] Foreign Application Priority Data

Jul. 30, 1981 [DE] Fed. Rep. of Germany ..... 3130071

[51] Int. Cl.[3] ..... G03C 3/00

[52] U.S. Cl. ..... 430/10; 40/626; 40/630; 156/230; 156/241; 283/77; 283/108; 283/112; 283/904; 427/7; 428/200; 428/206; 428/916

[58] Field of Search ..... 430/10, 12; 428/199, 428/916, 200, 206; 283/77, 108, 112, 904; 156/230, 241; 427/7; 40/626, 630

[56] References Cited

U.S. PATENT DOCUMENTS

| | | | |
|---|---|---|---|
| 3,614,839 | 10/1971 | Thomas | 430/10 |
| 3,871,119 | 3/1975 | Mayer | 428/916 |
| 3,909,469 | 9/1975 | Miller . | |
| 4,152,476 | 5/1979 | Stillman | 156/230 |
| 4,322,461 | 3/1982 | Raphael et al. | 283/112 |

FOREIGN PATENT DOCUMENTS

| | | |
|---|---|---|
| 981303 | 1/1976 | Canada . |
| 2260815 | 9/1976 | France . |

*Primary Examiner*—J. Travis Brown

*Attorney, Agent, or Firm*—Connolly and Hutz

[57] ABSTRACT

The tamperproof document consists of a photographic material as information carrier which is laminated on one or both sides with a transparent foil. The foil is attached to the surface of the information carrier by a layer of adhesive containing poly-1,2-alkyleneimine. The document is eminently safe against falsification.

14 Claims, No Drawings

TAMPERPROOF DOCUMENT AND A PROCESS FOR PRODUCING THE SAME

This invention relates to a photographic information carrier which is laminated with plastics foil on one or both sides and to a process for the production of the tamperproof document.

Tamperproof documents are becoming increasingly important. They are used, for example, in the form of credit cards for banks, retail stores, oil companies, airlines or credit companies to facilitate cash-free transactions. Such documents contain information relating to the owner and to the agency issuing the document and should in the interests of both parties be secured against falsification. There has therefore been no lack of attempts to make such information carriers tamperproof.

It is known, for example, that a card carrying printed information can be secured by enclosing it between two foils. The laminating foil is in this case prepared in certain areas so that it will not adhere to the surface of the paper in these areas. Any attempt subsequently to strip off the laminating foil will then cause the paper to be torn off with the foil in the areas which have not been so prepared since the force of the pull will be transferred to the less resistant paper surface (German Offenlegungsschrift No. 2,511,367).

According to another proposal, a printed information carrier consisting of a paper card with an edge of foil, a so-called "composite inlet", is welded between two clear foils. In this case, the foil border acts as a weld sealing the edges of the paper card so that the card is more difficult to split open (German Offenlegungsschrift No. 2,756,691).

According to British Pat. No. 1,518,946, a photographic paper used as information carrier is welded into a pair of transparent laminated foils by the application of pressure and temperature round the edges. The foils used for this purpose are ordinary commercial foils consisting of an outer layer of polyethylene terephthalate and an inner layer of polyethylene.

One disadvantage of the known laminating processes is that, when the laminated foils are welded, they are bonded only incompletely to the surface of the information carrier and therefore provide only limited protection against falsification. Welding round the edges does not provide any substantial improvement under these conditions since the weld can easily be removed and replaced. The known laminating processes have the further disadvantage that the laminating foil can be separated from the paper layer by heating or by chemical means.

It is an object of the present invention to provide a tamperproof document comprising an information carrier in the form of a photographic material which has previously been treated by a photographic process and a printing process and in which the whole surface of the information carrier is indissolubly connected with a transparent foil material, and the information on the information carrier is no longer accessible without destruction of the carrier and is thus securely protected against subsequent alteration.

The present invention thus provides a tamperproof document consisting of an information carrier in the form of a photographic material carrying information and laminated on one or both sides with at least one transparent foil, the document being characterised in that the foil is attached to the surface of the information carrier by a layer of adhesive containing poly-1,2-alkyleneimine.

The polyalkyleneimine resins used in the adhesive layer according to the invention are mainly polymerisation products of ethylene imine and of its C- and N-substitution products. The reactions resulting in such polymerisation products, which may contain oxygen, sulphur or phosphorous as hetero atoms in addition to nitrogen, are described in "Methoden de Organischen Chemie (HoubenWeyl)" Volume XIV/2, pages 568–579. Details concerning polymerised C-alkyl- and N-alkyl-derivatives of ethyleneimine may be found in German Patent Nos. 888 170 and 914 325. Reference may also be made to G. D. Jones, J. Org.Chem. 9, 484 (1944); L. D. Klapp, Am. Soc. 70, 184 (1948); Y. Minoura, M. Takebayashi and C. C. Price, Am Soc. 81, 4689 (1959); H. Bestian, Ang. Ch. 62, 451 (1950).

Homopolymers and copolymers of ethyleneimine, propyleneimine and butyleneimine have proved to be particularly suitable polyalkyleneimine resins, for example those described in U.S. Pat. No. 3,418,204 and particularly in U.S. Pat. No. 3,909,469. Polyethyleneimines having a molecular weight of from 40,000 to 60,000 are preferred.

The adhesive layers according to the present invention are prepared from aqueous solutions or dispersions containing polyalkyleneimine, optionally an acid or an alkylating agent, and preferably a modifying agent. These solutions are non-gelling aqueous solutions. The modifying agents used may be saturated or unsaturated lower aliphatic ketones and aldehydes, preferably with up to 6 C-atoms, e.g. formaldehyde, acetaldehyde, propionaldehyde, butyraldehyde, chloral, acetone or acrolein. Formaldehyde is a preferred modifying agent.

Polyfunctional compounds capable of reacting with the poly-1,2-alkyleneimine, in particular with its imino groups, have proved to be suitable modifying agents. Examples include polyhalohydrins, polyisocyanates, polyepoxides and polyaziridinyl compounds, such as e.g. epichlorohydrin, hexamethylene diisocyanate, polyvinyl cyclohexenedioxide, tris-(1-aziridinyl)-phosphine oxide and unsaturated carboxylic acids and derivatives thereof such as their chlorides and esters, e.g. acrylic acid, acrylic acid chloride or acrylates.

Preparation of the polyalkyleneimine as prepolymer or its cross-linking or chain-lengthening is accelerated by acids or alkylating agents. Both inorganic and organic acids are suitable for this purpose, e.g. aliphatic carboxylic acids having up to 6 carbon atoms, such as acetic acid, propionic acid, butyric acid, malonic acid and succinic acid or their anhydrides. Acetic acid is preferred. Carboxylic acids which have only limited solubility in water can in principle also be used. In that case, the solubility of the carboxylic acids may be increased by dissolving them in a water-miscible organic solvent, e.g. alcohol. The same effect is obtained with hydrohalic acids and sulphonic acids as well as borofluoride, borofluoride etherate, diazonium fluoborates, alkyl halides, dialkylsulphates, carboxylic and sulphonic acid chlorides and sulphonic acid esters. Compounds which split off acids may also be used, e.g. $\beta$-chloroethylamine, amine hydrochlorides and certain silver salts, particularly silver perchlorates.

The composition of the solution forming the adhesive layer may be varied within wide limits. One example of a suitable composition for an adhesive solution contains from 0.05 to 10% by weight of poly-1,2-alkyleneimine, from 0.01 to 2% by weight of modifying agent and optionally from 0.01 to 1% by weight of a carboxylic acid, based on the number of carboxyl groups in the carboxylic acid. A preferred composition for an adhesive layer contains from 0.1 to 5% by weight of polyethyleneimine, from 0.05 to 1% by weight of modifying agent, optionally from 0.05 to 0.2% by weight of a carboxylic acid conforming to the above definition, and the remainder water or other additives required for adjusting certain properties. The adhesive layers used according to the invention develop excellent bonding properties on drying and an unexpectedly high resistance to water.

In addition to the substances already mentioned above, small quantities of a thickener, or of a resin which further improves the water resistance of the adhesive layer after a heat treatment, or of a defoaming agent to prevent the formation of a foam which may have adverse effects for bonding, may be applied to the aqueous solution of adhesive. If the use of a thickener, an additional resin or a defoaming agent is envisaged, these additives may be used individually or together within the following quantities by weight: 0.01 to 1% by weight of thickener, e.g. a thickener from the group comprising hydroxyethylcellulose, polyvinyl alcohol and methylcellulose; 0.01 to 2% by weight of a resin such as melamine formaldehyde or urea formaldehyde resin; and 0.01 to 0.1% by weight of a defoaming agent, e.g. dimethylpolysiloxane.

The proportion by weight of thickeners or of resins to the polyalkyleneimine depends on the nature of these additives. Proportions ranging from 1:1 to 1:100 and particularly from 1:3 to 1:30 are generally suitable.

The transparent foil material may consist of thermoplasts, e.g. polyolefins such as polyethylene, polypropylene, cellulose esters, polyvinyl acetate, polystyrene, polyvinyl chloride, polyvinylidene chloride, polyvinyl fluoride, polytetrahalogenethylene, polycarbonate, in particular those based on bisphenol A, polyesters, in particular those based on polyethylene and polybutylene terephthalate, and polyamides, e.g. polyamide-6 or polyamide-6,6, polyamide-12 or copolyamides.

So-called composite foils composed of individual foils identical or different in chemical composition may, of course, also be used. The following are examples: polyethylene/polyamide, polypropylene/polyamide and polyolefine foils combined with other foil materials such as polyesters, e.g. polyethylene terephthalate. Suitable foils and composite foils are described in Ullmanns Encyklopädie der Technischen Chemie, 4th Edition, Volume 11, pages 673 et seq.

If composite foils are used for producing the laminate, the individual foils may be bonded together by means of the usual adhesive layers, preferably the same adhesive layers as those used for bonding the composite foil to the information carrier.

The thickness of the foils to be used according to the invention depends on the required rigidity of the identification document. Foil thicknesses of from 15 to 250 μm and particularly from 50 to 200 μm will generally be satisfactory.

The surface of the foil to which the adhesive layer is to be applied may be subjected to a preliminary treatment before application of the coating in order to ensure uniform application of the coating solution and increase its adhesiveness and thereby improve the bond between the foil and the adhesive layer. Satisfactory results may be obtained, for example, by a conventional corona treatment.

The adherence of the adhesive layer applied to the carrier foil may, of course, also be improved by other measures such as, for example, application of a suitable substrate layer.

Application of the adhesive layer composition to the foil may be carried out by the usual methods employed in the lacquer industry, such as spraying, roller application, application with doctor wiper, printing, immersion, centrifuging, flooding, spread coating, brush coating, etc.

The thickness of the adhesive layer when dry depends on the required characteristics and the envisaged bonding effect. Layers having a dry thickness of from 0.05 to 10 μm will generally provide satisfactory results. Dry layer thicknesses of from 0.05 to 2 82 m are preferred and applications providing from 0.05 to 0.5 g of dry layer per $m^2$, based on the poly-1,2-alkyleneimine, are particularly preferred.

The information carrier will generally consist of a conventional photographic material, that is to say one containing a light-sensitive silver halide emulsion layer on a conventional layer support. The information of silver or dye contained in this layer is produced by imagewise exposure and conventional photographic processing. The information carrier may consist of photographic paper or of film carrying black-and-white or colour photographic recordings, images and/or marks and/or other information or features for identification. The layer support of such photographic information carriers may be made of the usual materials used in technical or art photography. The following are examples: paper, paper covered with reflective layers, polyolefine-laminated paper, and the usualy film supports, e.g. of cellulose triacetate or polyesters, optionally in the form of pigmented, opaque layer supports. The photograhic emulsion or auxiliary layers of such information carriers have the usual compositions used in photographic materials.

The light-sensitive photographic layers provided in the information carriers may be, for example, layers based on non-sensitized silver halide emulsions or on spectrally sensitized silver halide emulsions. In other words, the known gelatine layers used for various photographic black-and-white processes, colour processes, negative, positive and diffusion transfer processes and printing processes may be employed. The binder contained in the photographic gelatine layers need not necessarily be gelatine alone but may include chemically modified gelatine, e.g. acylated, acetylated, hydroxylated or esterified gelatine or gelatine which has been modified by graft polymerisation in known manner or mixtures of gelatine with other hydrophilic colloids, e.g. cellulose derivatives, polyvinyl alcohols, polyvinyl pyrrolidones, hydrolysed polyvinyl acetates, alginic acid, colloidal albumin or zein. The layers, both those which are light-sensitive and those which are not sensitive to light, may also contain the usual additives used for modifying the mechanical properties of photographic layers, e.g. polymers based on acrylates or methacrylates, styrene/maleic acid copolymers or copolymers of styrene/maleic acid anhydride semialkylesters, or coating auxiliaries such as polyethylene glycol aryl ethers and other conventional photographic auxiliaries.

In addition to information, the information carriers may carry various types of other security or identification features which may be produced either photographically or by writing, printing or embossing. The carriers may also, of course, carry data applied, for example, by typewriter or magnetically and optically readable data. In this respect, the information carrier according to the invention in no way differs from information carriers used in known documents.

Other security features, both those which are visible to the naked eye and those which cannot be detected, e.g. features made of substances absorbing UV light, may be present in the information carrier, e.g. a layer support made of paper may carry watermarks, or other features may be produced in the outer foil, e.g. in a composite foil. Various means of providing such security features in documents to render then more proof against falsification are described, for example, in the following documents: German Offenlegungsschriften No. 3,013,238, No. 1,446,851 and No. 2,908,742, U.S. Pat. No. 3,679,448, British Pat. No. 1,519,715, German Auslegeschrift No. 2,756,692 and U.S. Pat. Nos. 2,373,540 and 4,066,873.

The polymers used for the layer supports of the information carrier, e.g. the polymer used for laminating the paper support or the polymer of which the film support is made, which may be a cellulose ester, and the polymers of the foils used for laminating the information carrier are preferably selected so that the softening point of the polymer in the layer support is lower than that of the foil material.

It has been found that, if polyolefine-laminated paper is used as a layer support for the information carrier, it is advantageous to provide the paper with a polyolefine having a melting point which is lower by about 10° to 30° C. than the melting point of the foil carrying the adhesive layer of the foil material.

To laminate the foil covered with adhesive layer to the surface of the information carrier, the foil is heated to about 50° to 150° C. and pressed against the surface of the information carrier in such a manner that the laminate obtained is free from bubbles and creases. Lamination is assisted by the application of pressures in the region of from 1 to 10 kp/cm$^2$.

The process of laminating, which is preferably carried out on both sides of the information carrier, is advantageously carried out continuously by bringing the individual information carriers together with the foil covered with adhesive layer as the said foil is run off supply rolls. The parts containing the information carriers may subsequently be punched out of the resulting bond of laminate so that the welded foil is severed at a distance of about 1 to 2 mm from the edge of the information carrier, depending on the thickness of said carrier. The information carrier obtained is enveloped in a covering which is closed on all sides so that subsequent welding of the edges is superfluous. The same results are, of course, obtained by intermittent laminating with separate sheets of foil.

The documents described are eminently safe against falsification. Just as the foils are joined to the information carrier, so also the parts of foil projecting over the information carrier are joined together virtually indissolubly. Even with the aid of heat it is not possible to separate the document without completely destroying the information carrier.

Another important and unexpected advantage of the identification documents or cards according to the invention containing adhesive layers of polyalkyleneimine is that they lie completely flat. It is particularly in this respect that the documents according to the invention are superior to known documents.

EXAMPLE 1

100 g of an aqueous 2% by weight polyethyleneimine solution were mixed with 0.1 g of glacial acetic acid and 2 ml of an aqueous 40% by weight formaldehyde solution and then applied to a polyethylene foil. The surface of the polyethylene foil was exposed to corona radiation before casting. The dried layer contained 0.1 g of polyethyleneimine per m$^2$.

The information carrier used was a conventional photographic paper having a layer support of paper laminated with polyethylene on both sides and weighing approximately 120 g/m$^2$. The softening point of the polyethylene in the layer support was 110° C. The layer support was equipped with a light-sensitive silver halide-gelatine emulsion layer and a gelatine-containing protective layer and backing layer, both of the same composition. A photograph of the owner of the document together with the appropriate information was produced on the information carrier by exposure, development and fixing.

The information carrier having the identification features applied photographically and by printing was then placed between two of the above mentioned polyethylene foils (softening point of foils about 122° C.) so that the adhesive layers of the foils were brought into contact with the two surfaces of the information carrier and the foils projected over the edge of the information carrier by approximately 1 mm. The packet was then passed between two rollers heated to 90° C., and pressed together at a pressure of about 1.5 kp/cm$^2$.

When the documents had cooled, the polyethylene foils were so firmly bonded to the information carrier that when an attempt was made to separate the document in the heated state (about 100° C.) after the bonded edges had been cut off, the paper substrate of the information carrier was destroyed but its remnants were fixed to the foils, which moreover had been irreversibly stretched.

EXAMPLE 2

The solution for producing the adhesive layer described in Example 1 was applied to a corona-irradiated polyethylene terephthalate foil which was then bonded to a corona-irradiated polyethylene foil by passing the two foils between two rollers heated to 90° C. under a pressure of 5 kp/cm$^2$ to produce a composite foil.

The information carrier was a photographic film material comprising a layer support of cellulose triacetate pigmented with titanium dioxide and provided with the usual substrate layers, a silver halide-gelatine emulsion layer, a protective layer over the emulsion layer, and a backing layer. The protective layer and backing layer were produced from the usual aqueous gelatine solutions used for such layers.

A photograph of the owner of the identification document together with the appropriate information was applied to this information carrier by exposure, development and fixing.

To produce the document, the polyethylene surface of the composite foil was coated with a layer of adhesive having the same composition as that used for production of the composite foil and laminated to the information carrier as described in Example 1.

The result was an identity card which laid completely flat. The document could no longer be separated into its parts without completely destroying the photographic material used as information carrier.

EXAMPLE 3

Example 2 was repeated, but instead of using the adhesive layer described in Example 1, the adhesive layer used both for bonding the various layers of the composite foil together and for bonding the composite foil to the information carrier was one made of a two-component material based on a polyisocyanate and a resin component containing hydroxyl groups (laminating adhesive EPS 71 of Dr. Kurt Herberts, Wuppertal).

The document did not lie sufficiently flat and the bond between the layers of foils deteriorated in the course of time so that, after about one week, the layers could be separated without lasting damage to the information carrier.

We claim:

1. A tamperproof document consisting of an information carrier in the form of a photographic material covered with information and laminated on both sides to at least one transparent foil, characterised in that the photographic material has a gelatin-containing outer front-layer and the foil is bonded to the surface of the said gelatin-containing layer by means of an adhesive layer containing a poly-1,2 -alkyleneimine.

2. A document according to claim 1, characterised in that the adhesive layer contains from 0.05 to 0.5 g of a poly-1,2-alkyleneimine per $m^2$.

3. A document according to claims 1 or 2, characterised in that the poly-1,2-alkyleneimine is a polyalkyleneimine modified with ketones or aldehydes.

4. A document according to claim 3, characterised in that the poly-1,2-alkyleneimine has been modified with formaldehyde.

5. A document according to claims 1 or 2, characterised in that the poly-1,2-alkyleneimine is polyethyleneimine.

6. A document according to claims 1 or 2, characterised in that, in addition to containing a poly-1,2-alkyleneimine, the adhesive layer contains a melamine-formaldehyde or ureaformaldehyde resin.

7. The document according to claims 1 or 2, characterised in that the photographic material contains a layer support of paper with at least one layer containing a photographic image and optionally other photographic auxiliary layers.

8. A document according to claim 7, characterised in that the layer support is a paper coated on both sides with polyolefine.

9. A document according to claims 1 or 2, characterised in that the transparent foil consists of one or more thermoplasts from the group comprising polyethylene, cellulose esters, polyvinyl acetate, polypropylene, polystyrene, polyvinyl chloride, polyvinylidene chloride, polyvinylfluoride, polytetrahalogenethylene, polycarbonate based on bisphenol A, polyethylene terephthalate, polybutylene terephthalate and polyamide.

10. A document according to claim 9, characterised in that a composite foil formed from two or more of the foils is used.

11. A document according to claim 10, characterised in that the foil carrying the adhesive layer of the composite material consists of polyethylene.

12. A process for the production of tamperproof documents by laminating an information carrier consisting of a photographic material with foils on both sides, characterised in that the photographic material has a gelatin-containing outer front layer to which identifying features have been applied by imagewise exposure and photographic processing and a gelatin-containing backing layer and the foil is coated with an aqueous solution containing a poly-1,2-alkyleneimine, the layer is dried, and the foil is laminated with simultaneous application of heat and pressure to a surface of the said gelatin-containing outer front-layer.

13. A process according to claim 12, characterised in that the aqueous solution contains from 0.05 to 10% by weight of poly-1,2-alkyleneimine, from 0.01 to 2% by weight of an aldehyde or ketone and optionally from 0.01 to 1% by weight of a carboxylic acid, based on the carboxyl group content.

14. A tamperproof document consisting of an information carrier in the form of a photographic material covered with information and laminated on both sides to at least one transparent foil, characterised in that the photographic material has a gelatin-containing outer front-layer and a gelatin-containing backing layer and the foil is bonded to the surface of the said gelatin-containing layers by means of an adhesive layer containing a poly-1,2-alkyleneimine.

* * * * *